US005839457A

United States Patent [19]

Rijken et al.

[11] Patent Number: 5,839,457

[45] Date of Patent: Nov. 24, 1998

[54] DEVICE FOR RINSING OBJECTS

[75] Inventors: Martinus M. Rijken, Drachten; Teunis Tel, Groningen, both of Netherlands

[73] Assignee: U.S. Philips Corporation, New York, N.Y.

[21] Appl. No.: 882,441

[22] Filed: Jun. 25, 1997

Related U.S. Application Data

[62] Division of Ser. No. 570,307, Dec. 11, 1995, abandoned.

[30] Foreign Application Priority Data

Dec. 12, 1994 [EP] European Pat. Off. ..... 94203597

[51] Int. Cl.[6] ..... B08B 3/04

[52] U.S. Cl. ..... 134/110; 134/117; 134/196

[58] Field of Search ..... 68/213, 96; 134/147, 134/117, 184, 186, 901, 110, 111, 136, 196

[56] References Cited

U.S. PATENT DOCUMENTS

| | | | |
|---|---|---|---|
| 1,421,971 | 7/1922 | McCarty . | |
| 3,066,687 | 12/1962 | Rohmann | 134/148 |
| 3,512,539 | 5/1970 | Hamilton | 134/136 |
| 3,762,426 | 10/1973 | Yakubowski | 134/196 X |
| 4,700,729 | 10/1987 | Thaler | 134/901 X |
| 4,721,124 | 1/1988 | Tuerkheimer et al. | 134/147 X |

FOREIGN PATENT DOCUMENTS

| | | | |
|---|---|---|---|
| 182095 | 5/1955 | Austria | 68/213 |
| 648291 | 2/1979 | U.S.S.R. . | |
| 1201003 | 12/1985 | U.S.S.R. . | |

*Primary Examiner*—Philip R. Coe
*Attorney, Agent, or Firm*—Ernestine C. Bartlett

[57] ABSTRACT

A device for rinsing objects has a holder (1) for supporting an object (4) to be cleaned, two passages (8, 9) at opposite sides of the object situated in the holder in operation, and two reservoirs (10, 11) for holding rinsing liquid (18), a first reservoir (10) communicating with a first passage (8) and a second reservoir (11) communicating with a second passage (9), and at least the first reservoir (10) having a variable volume.

20 Claims, 10 Drawing Sheets

DEVICE FOR RINSING OBJECTS

This is a division of application Ser. No. 08/570,307, filed Dec. 11, 1995, and now abandoned.

FIELD OF THE INVENTION

The invention relates to a device for rinsing objects. The purpose of this is to clean the objects.

BACKGROUND OF THE INVENTION

Devices are known by means of which it is possible to clean a shaver head, i.e. the shear plate and the cutter situated underneath this plate. Such devices are described in, for example, FR-A-2,568,111 and DE-U-1,781,494. However, the cleaning action of such devices is unsatisfactory.

SUMMARY OF THE INVENTION

It is an object of the invention to provide a simple device which enables objects to be cleaned rapidly and effectively.

To this end the device in accordance with the invention is characterised in that the device comprises a holder for supporting an object to be cleaned, two passages at opposite sides of the object situated in said holder in operation, and two reservoirs for holding rinsing liquid, a first reservoir communicating with a first passage and a second reservoir communicating with a second passage, and at least the first reservoir having a variable volume. A pressure variation in one of the reservoirs causes the volume of this reservoir to change and rinsing liquid to be forced from one reservoir to the other reservoir, thus causing the liquid to flow over and past the object and thereby subject the object to an effective cleaning action.

A preferred embodiment of the invention is characterised in that the first reservoir is an elastic bellows. By exerting manual pressure on the elastic bellows the rinsing liquid is forced from the bellows reservoir to the other reservoir, thus producing a strong current of liquid over and past the object and thereby exerting a cleaning action.

A modification of this embodiment is characterised in that both reservoirs are formed by elastic bellows. In the non-loaded condition one bellows occupies a large volume and the other bellows a small volume. This provides a better resilient action during operation. When the bellows filled with the rinsing liquid is depressed the liquid is forced from this first bellows into the second bellows. After release of the bellows the resilience of both bellows is utilized for the return stroke, in which the liquid is forced back to the first bellows and again exerts a cleaning action on the object. In order to enhance the resilient action one of the bellows may be supported by a spring.

Instead of one or two bellows it is also possible to provide the holder with a piston which is movable in a vessel with rinsing liquid. If desired, the piston may be spring-loaded for the return stroke.

The rinsing device may further comprise a valve system with a filter to catch contaminants. As a result of this, the object is rinsed with a comparatively clean liquid during each pumping stroke. Moreover, the device may comprise means for the generation of a turbulent flow, for example in that air is forced in or drawn in during the pumping strokes.

BRIEF DESCRIPTION OF THE DRAWINGS

Many variants are conceivable as will be apparent from the following examples. Eight different examples will be described in more details with reference to FIGS. 1 to 12 of the diagrammatic drawings.

DETAILED DESCRIPTION OF THE PREFERRED EMBODIMENTS

Figure 1:
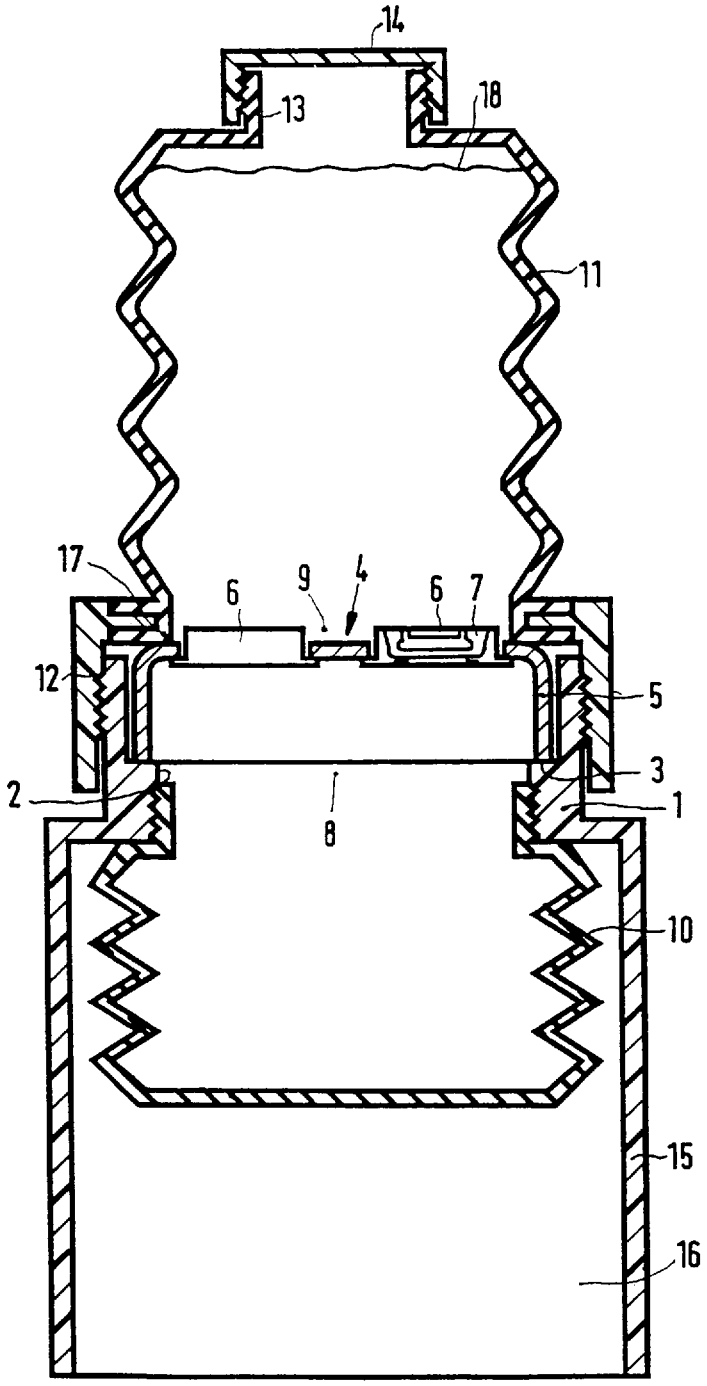
FIG. 1 is a diagrammatic sectional view of a rinsing device of the invention.

FIG. 1 shows a first example. The device has a holder 1 with an opening 2. An object to be cleaned can be placed on an edge 3 bounding this opening of the holder. In the present as well as the following Figures this object is a shaving unit 4 of a rotary dry-shaver, which unit comprises a shaving-head holder 5 in which perforated cutter guards 6 with internal cutters 7 are mounted. A passage 8, 9 at opposite sides of the object 4 communicates with a first and a second reservoir, respectively. The first reservoir is an elastic bellows 10 secured to the holder 1. In a non-loaded condition the bellows 10 occupies a small volume. The second reservoir is also an elastic bellows 11. In a non-loaded condition the bellows 11 occupies a large volume. At the location of the passage 9 an end portion of the bellows 11 is connected to a ring 12. This ring enables the bellows to be detachably secured to the holder 1, for example by screwthread means. The bellows 11 has a filling port 13 to fill the bellows 11 with a rinsing liquid. The filling port 13 can be closed by means of a filler cap 14. The holder 1 further has an extension 15 with which the device can be placed, for example, onto a tabletop. This extension 15 also creates a space 16 for the bellows 10.

The device operates as follows: After the object 4 to be cleaned has been placed into the holder 1 the bellows 11 is fitted onto the holder by means of the ring 12. The object is then retained between the edge 3 of the holder and an edge 17 of the bellows 11. After this, the bellows 11 is filled with a rinsing liquid and the filling port 13 is closed with the filler cap 14. Subsequently, the bellows 11 is pressed down by hand, causing the rinsing liquid 18 to be forced over and past the object to the bellows 10. As a result, the bellows 10 is pressed down and expanded. Both bellows are now under load. Once the bellows 11 is wholly pressed down it is released, as a result of which the rinsing liquid is forced back from the bellows 10 to the bellows 11, thereby causing the rinsing liquid to flow again past and over the object. If necessary, this may be repeated a few times until the object is sufficiently clean.

Figure 2:
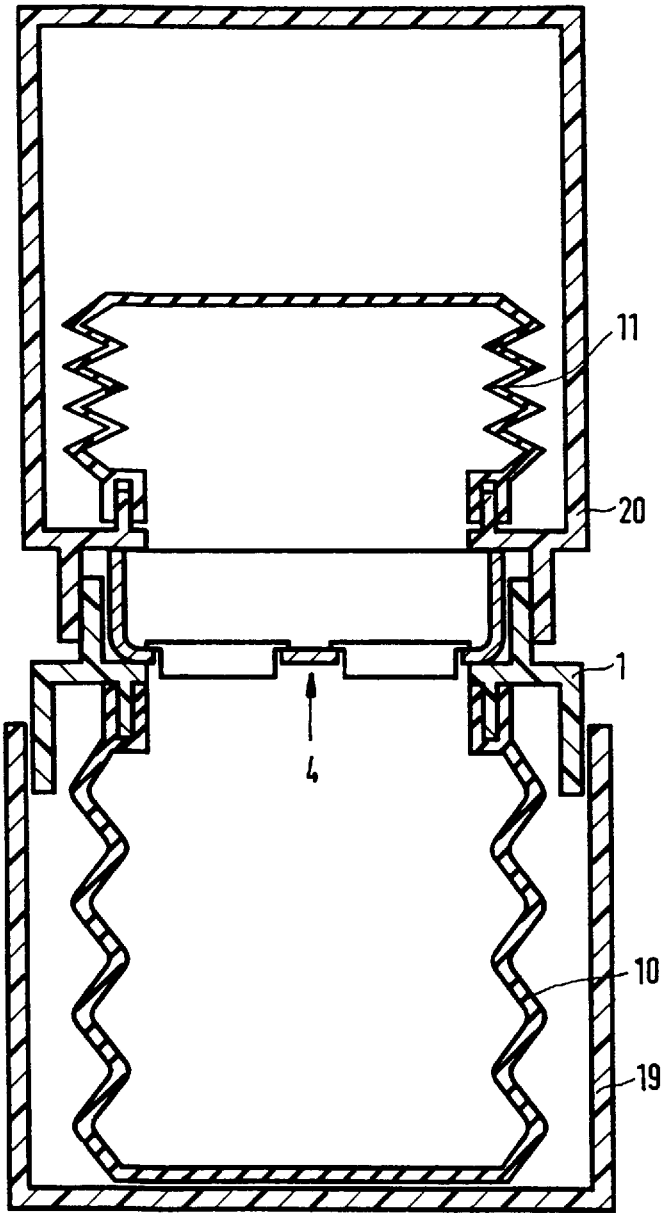
FIG. 2 is a diagrammatic sectional view of a second embodiment of a rinsing device of the invention.

FIG. 2 shows a second example and is a variant of FIG. 1. The holder 1 to which the bellows 10 is secured is slidable in a housing section 19. The ring 12 of FIG. 1, to which the bellows 11 is secured, is now replaced by a housing section 20. The bellows 11 does not have a separate filling port as in FIG. 1. The bellows are shown in their non-loaded conditions. Firstly, the bellows 10 is filled with rinsing liquid. Then the object is placed into the holder 1 and the housing section 20 is fitted onto the holder, for example by screwthread means. By moving the housing section 20 up and down the rinsing liquid will flow over and past the object from the one bellows to the other bellows and vice versa.

Figure 3:
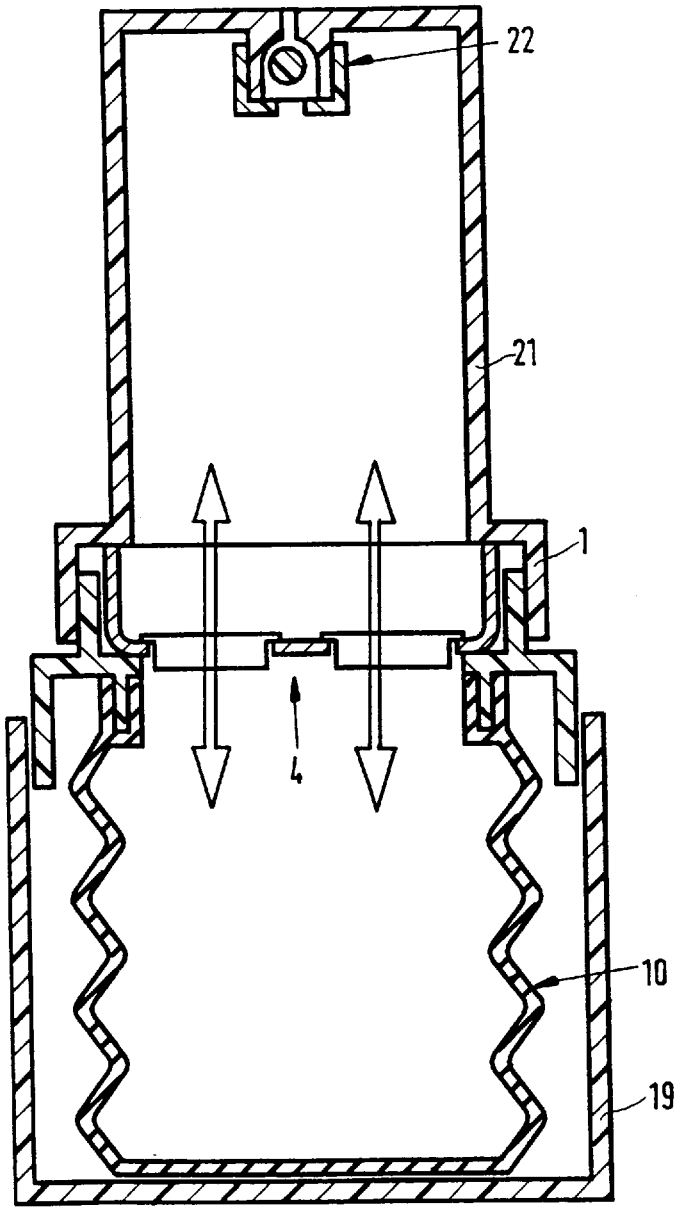
FIG. 3 is a diagrammatic sectional view of a third embodiment of a rinsing device of the invention.

FIG. 3 shows a third example, based on the second example. The second bellows 11 has now been dispensed with and replaced by a reservoir 21 having a fixed volume. It is then necessary to provide a vent valve 22 at the top of the reservoir. The operation is further similar to that of the second example.

Figure 4:
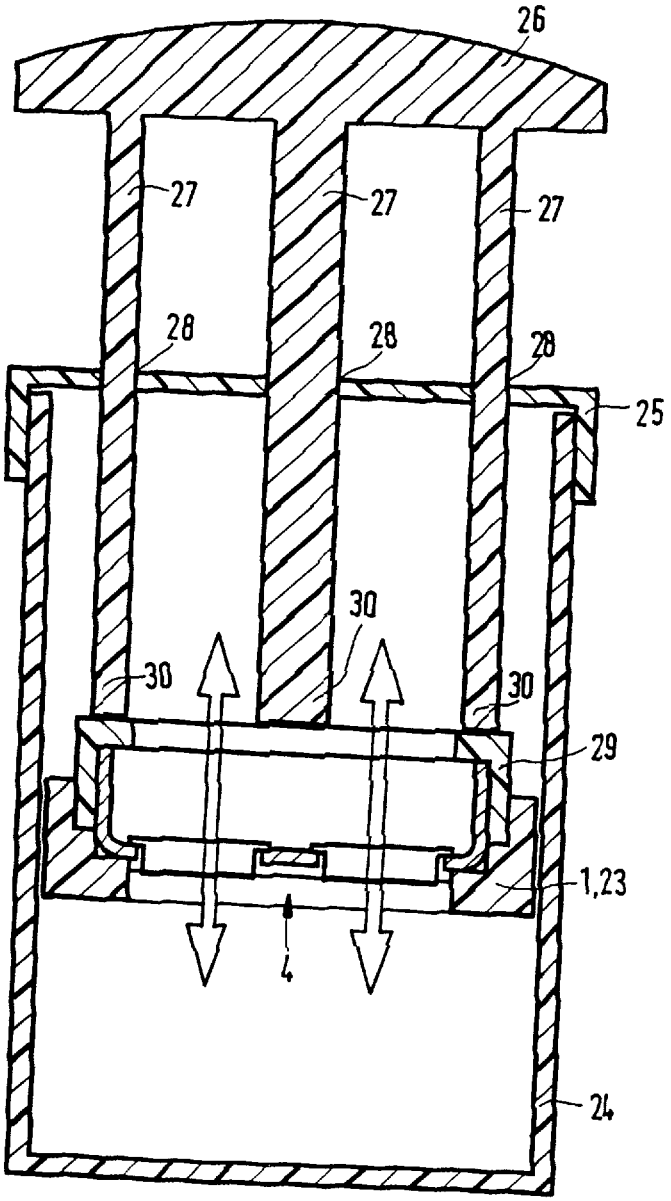
FIG. 4 is a diagrammatic sectional view of a fourth embodiment of a rinsing device of the invention.

FIG. 4 shows a fourth example. In this example the holder 1 is constructed as a piston 23 which is movable in a vessel 24. The vessel can be closed with a cover 25. The piston is actuated by a handle 26. For this purpose portions 27 of the handle pass through openings 28 of the cover. A ring 29 is fitted onto the holder/piston. After the object 4 has been placed into the holder 1 the ends 30 of the portions 27 of the handle 26 are secured to the ring 29. The vessel is first filled with a rinsing liquid, then the handle 26 and the holder/piston 23 with the object 4 are inserted into the vessel, after which the cover 25 is fitted onto the vessel. The object is cleaned by moving the handle up and down.

Figure 5:
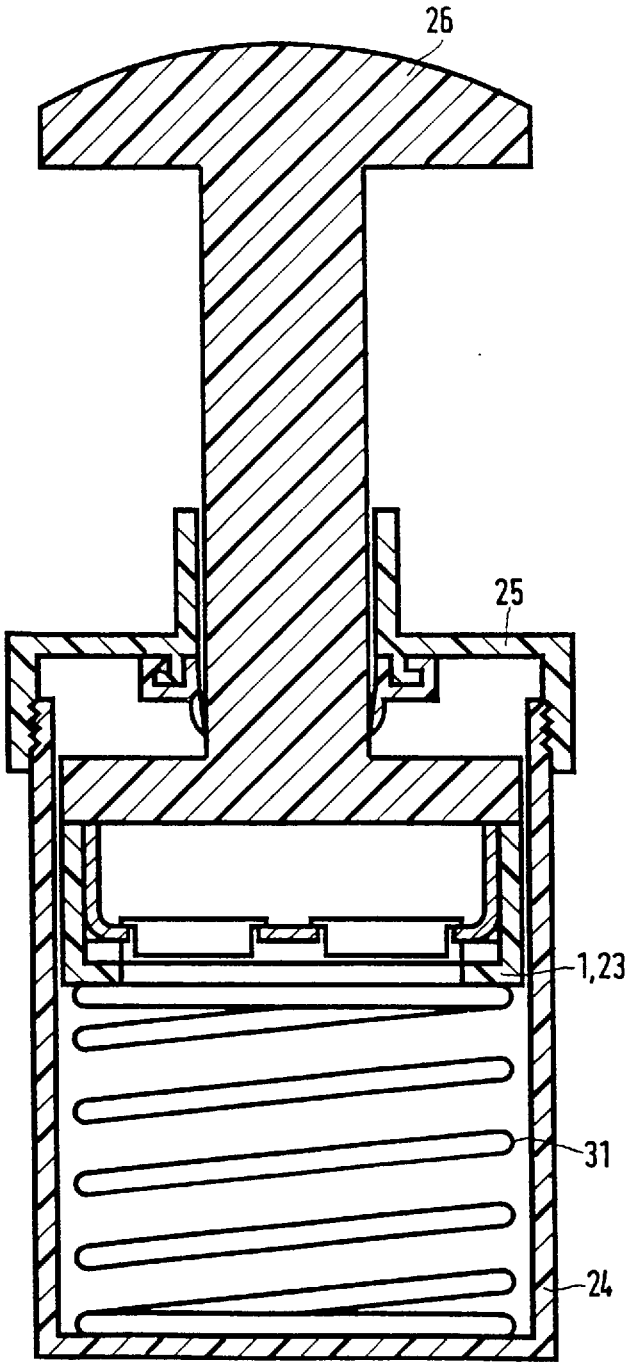
FIG. 5 is a diagrammatic sectional view of a fifth embodiment of a rinsing device of the invention.

FIG. 5 shows a fifth example which is a variant of the fourth example. The only essential difference is that the piston 23 is now supported by a spring 31. The return stroke of the piston is now produced by the spring 31 instead of by hand.

Figure 6:
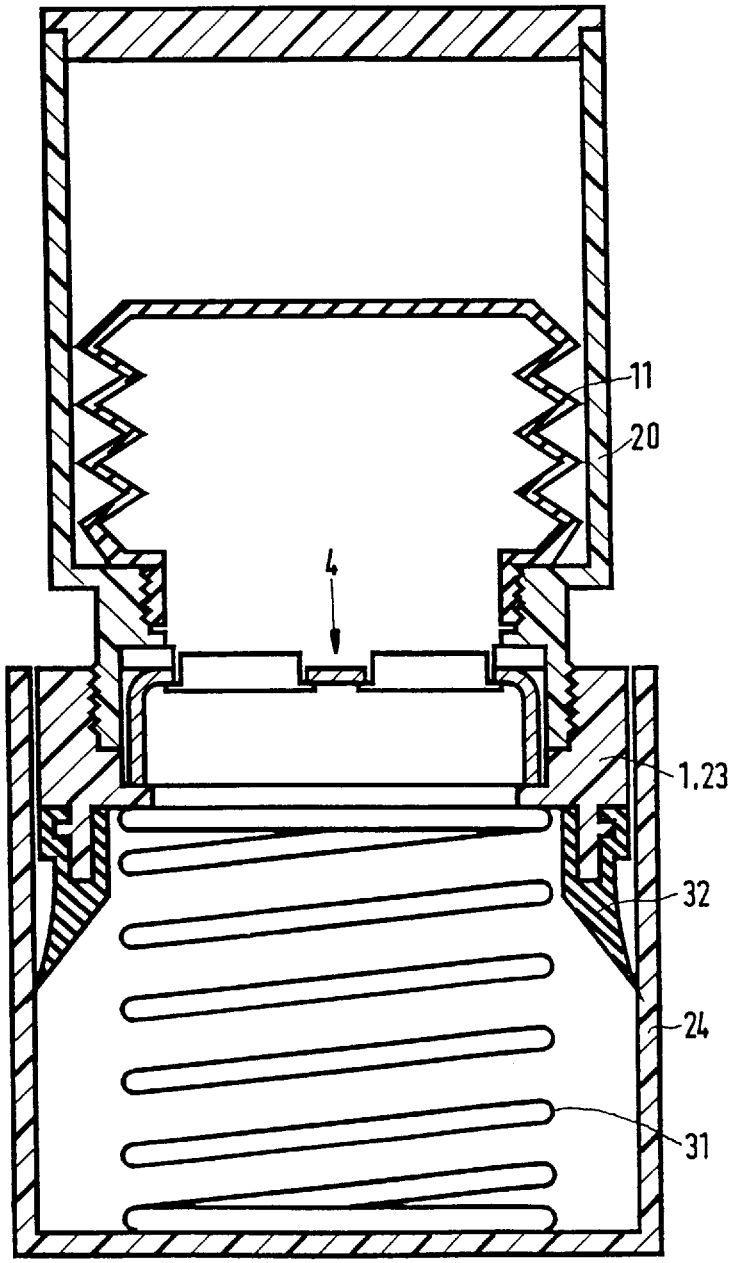
FIG. 6 is a diagrammatic sectional view of a sixth embodiment of a rinsing device of the invention.
Figure 7:
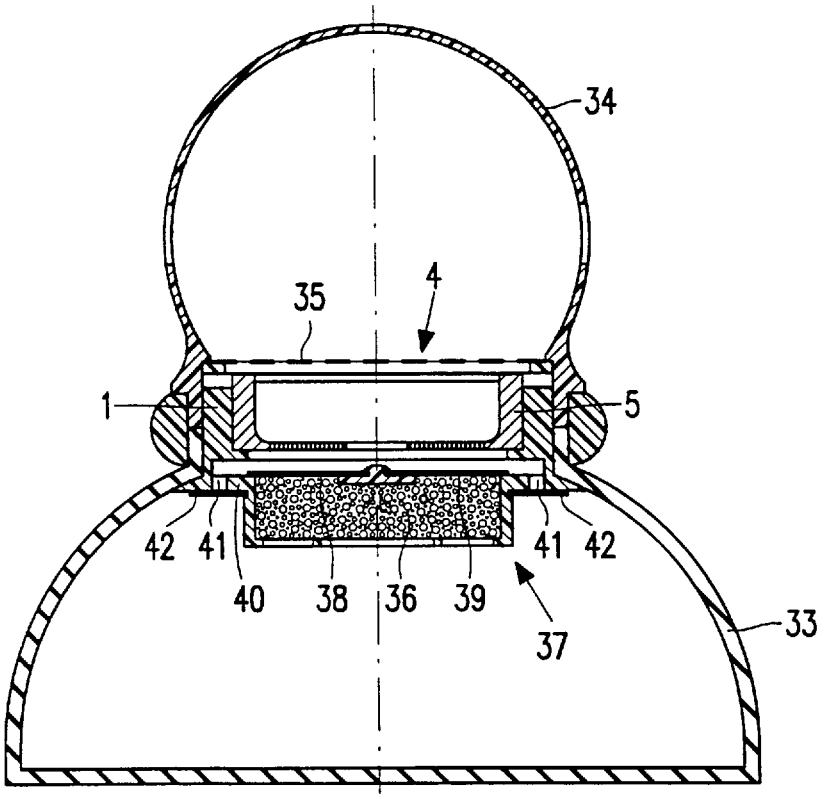
FIGS. 7, 8 and 9 are diagrammatic sectional views showing an embodiment of a rinsing device of the invention wherein the bellows is replaced by a flexible diaphragm.
Figure 8:
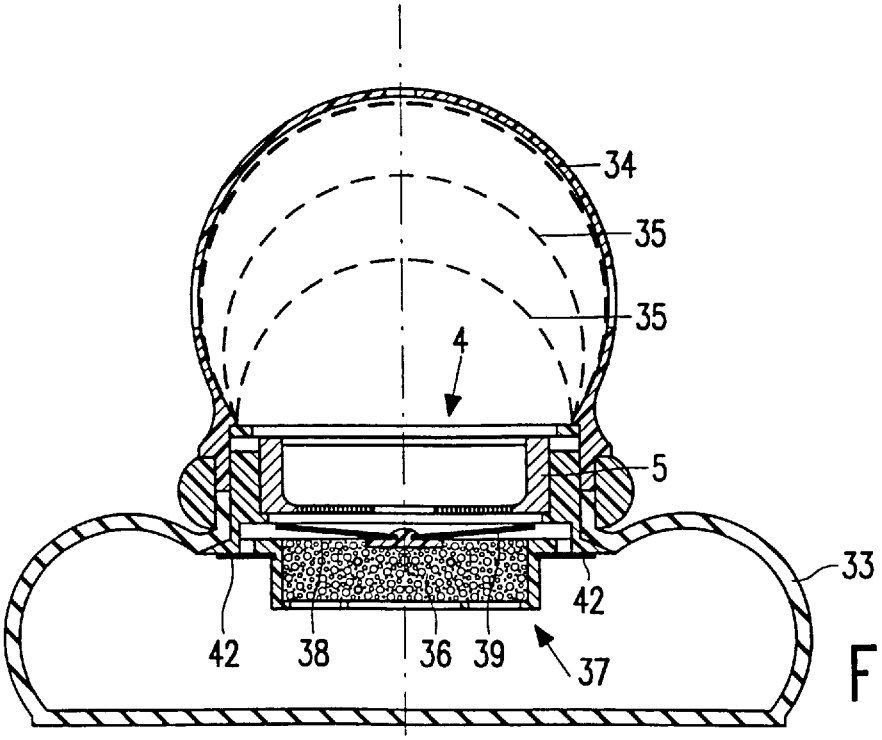
Figure 9:
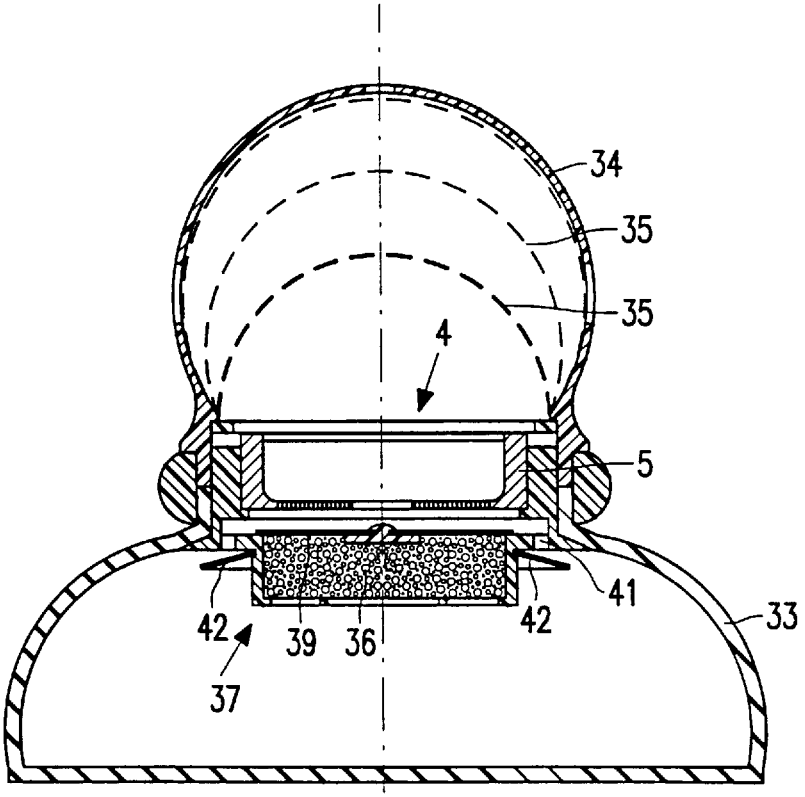
Figure 10:
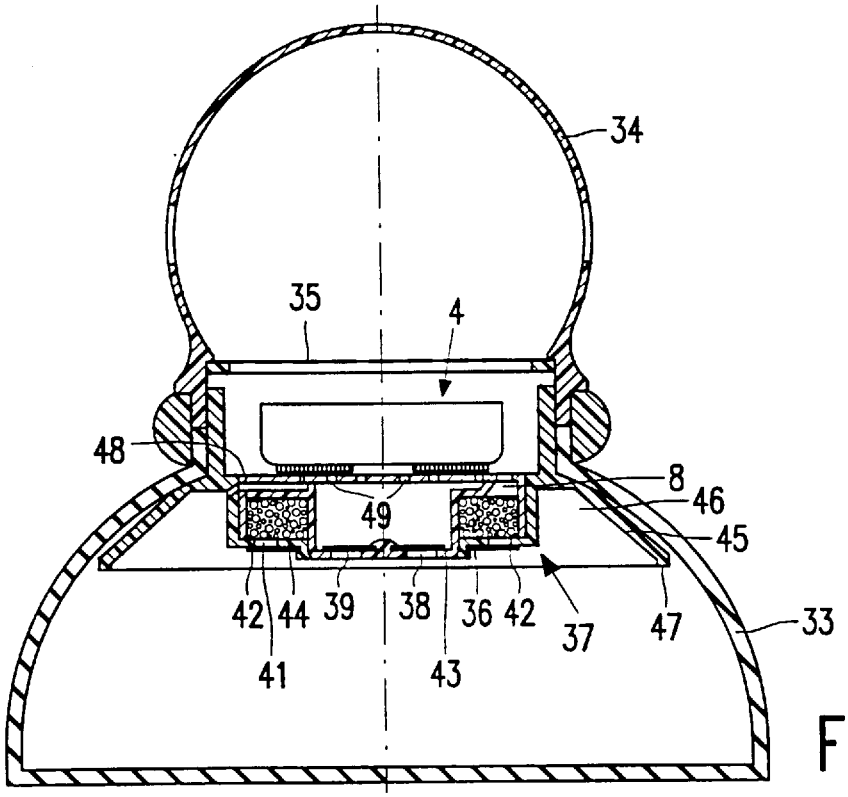
FIGS. 10, 11 and 12 are diagrammatic sectional views showing a second embodiment of a rinsing device of the invention wherein the bellows is replaced by a flexible diaphragm.
Figure 11:
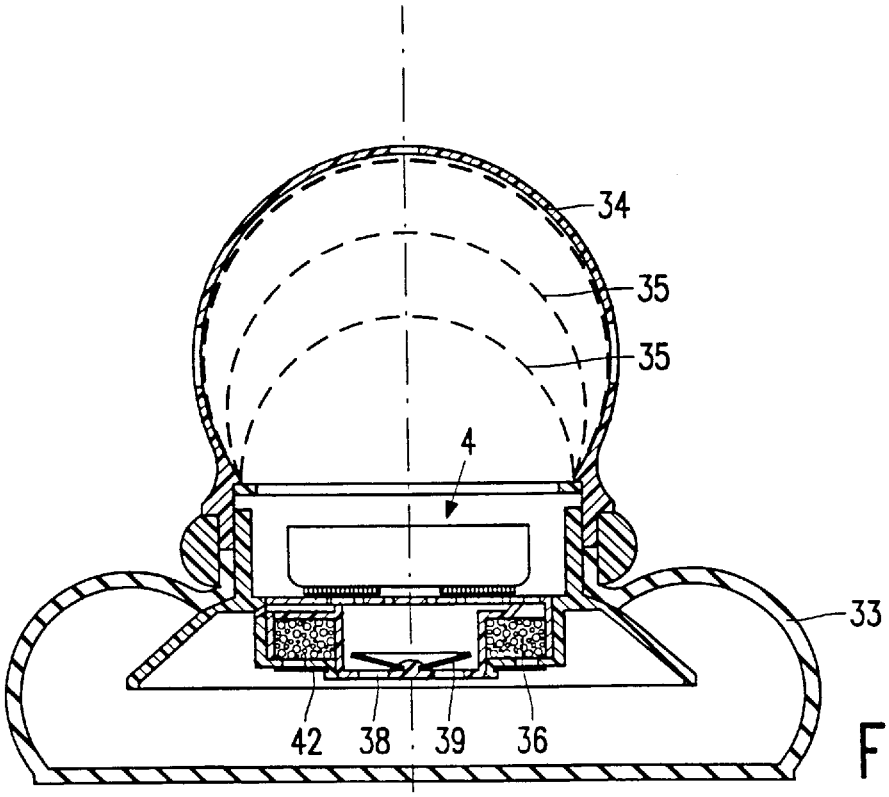
Figure 12:
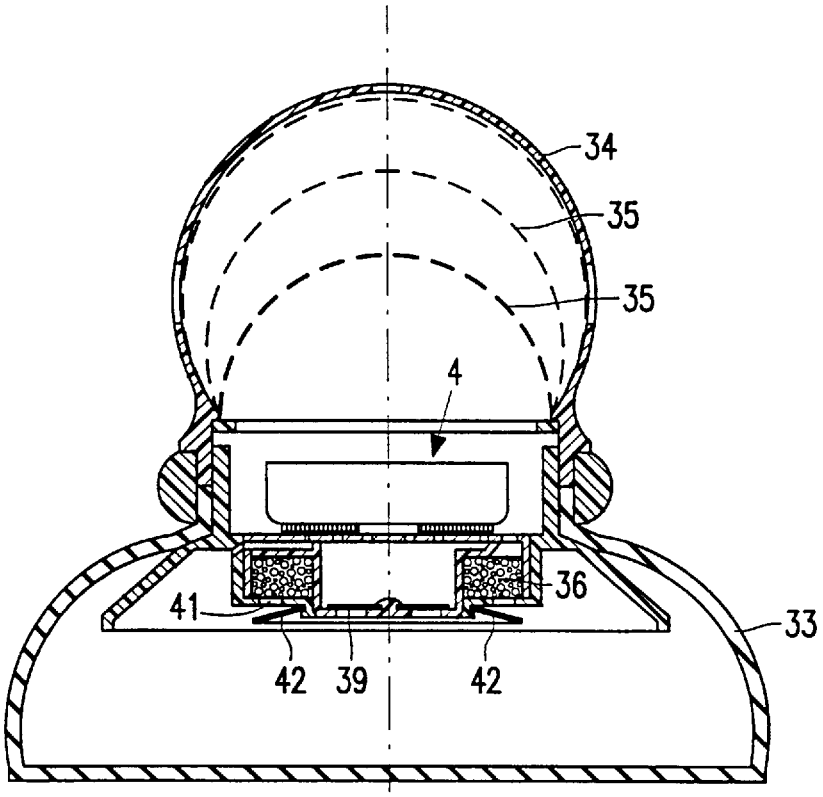

FIG. 6 shows a sixth example. This device uses a combination of a bellows 11 and a piston 23 supported by a spring 31. The piston is provided with a flexible sealing ring 32 for a correct sealing relative to the wall of the vessel 24. The vessel 24 is first filled with rinsing liquid via the opening 2 in the holder 1. After this, the object is introduced and subsequently the housing section 20, to which the bellows 11 is secured, is fitted into the holder 1. By pressing down the housing section 20 the liquid is pumped from the vessel 24 to the bellows 11 and flows past and over the object 4, thereby cleaning this object. In the process of this the spring 31 is compressed and the bellows 11 is expanded. When the housing section 20 is released the liquid is forced back in the opposite direction under the influence of the force of the spring and the bellows.

Obviously, many other variants are conceivable. For example, a bellows may be replaced by a flexible diaphragm which acts as a kind of balloon. Two variants of such an embodiment are shown in FIGS. 7–9 and FIGS. 10–12. The device has an elastically depressible lower housing section 33 on which a rigid upper housing section 34 can be mounted. The elastic housing section 33 forms the first reservoir. A flexible diaphragm 35 is arranged in the upper housing section. When the upper housing section 34 is pressed down the elastic lower housing section 33 is depressed, as a result of which the rinsing liquid to flow through the object 4 to be cleaned, thereby causing the flexible diaphragm 35 to be deformed as indicated in broken lines in FIGS. 8 and 11. The space underneath the diaphragm 35 forms the second reservoir. Releasing the upper housing section 34 causes a flow in the opposite direction.

In these two embodiments the device also comprises a filter 36. In the first variant (FIGS. 7–9) the filter is arranged in the passage 8 giving access to the first reservoir. The filter is situated in a box 37 which is open at the bottom and the top, an opening 38 at the top being provided with a first flexible valve 39. The box is secured to the holder 1 in which the object 4 to be cleaned is placed. Between a peripheral edge 40 of the box and the holder 1 openings 41 are formed, which are closed by a common second flexible valve 42. This operates as follows: when the upper housing section 34 is pressed down, the elastic lower housing section 33 is depressed, which reduces the volume of the first reservoir. The rinsing liquid is thus, pressurized and is forced up through the filter 36. The first flexible valve 39 then opens, whereas the second flexible valve 42 for the openings along the box periphery is closed. The rinsing liquid flows past and through the object to be cleaned and pushes the flexible diaphragm 35 upward, as is shown in broken lines in FIG. 8. After release of the upper housing section 34 the liquid is forced back to the lower reservoir via the object under the influence of the resilience in the diaphragm and the lower housing section 33 (see FIG. 9). The first valve 39 is then closed and the second valve 42 at the periphery of the box 37 is opened. The liquid with contaminants finds its way to the lower reservoir. Upon the next depression stroke the contaminants are caught in the filter 36.

In the second variant (FIGS. 10–12) the filter is ring-shaped and is also arranged in a box-shaped structure. A central wall portion 43 of the filter box 37 has openings 38, which can be opened or closed by a common first flexible valve 39 and at the location of the ring-shaped filter 36 a wall portion 44 of the filter box 37 has openings 41, which can be opened or closed by a common second flexible valve 42. When the upper housing section 34 is pressed down the valve 39 is opened and the valve 42 is closed (see FIG. 11). During the return stroke the valve 39 is closed, thereby forcing the liquid with the contaminants through the filter, the valve 42 then being opened (see FIG. 12). As a result, the objects are always rinsed with a comparatively clean liquid, which promotes the cleaning action.

In the second variant described above a bell-shaped wall portion 45 has been provided in the lower reservoir in order to create an air space 46. The filter 36 is disposed in this air space. In this way it is achieved that air is entrained by the circulating liquid, resulting in a more turbulent flow. When the lower reservoir is filled, for which the central wall portion 43 of the filter box 37 is removed, an air space is formed automatically as a result of the bell-shaped structure. The edge 47 of the bell-shaped wall portion 45 should then project from underneath the filter box 37. The turbulence can be further increased by the use of a plate 48 with a multitude of apertures 49. This plate is arranged in the passage 8 to the lower reservoir, right underneath the object 4.

Another possible variant is that in which the pumping action or suction is not produced by hand but by means of a motor-driven pump. The pump then alternately raises the pressure in the one and in the other reservoir.

The reservoirs need not be situated directly at opposite sides of the object to be cleaned but they may, for example, also be situated further away. The reservoirs are then connected to the passages at opposite sides of the object by means of conduits.

Perforate objects can thus be cleaned very well. However, cleaning is also possible when the objects are imperforate. In that case the walls of the opening 2 of the holder 1 may be provided with, for example, projections between which recesses are formed to allow the passage of the liquid.

It is also possible to use an exchangeable holder, i.e. a given rinsing device is used in conjunction with different holders for objects of different shapes.

We claim:

1. A device for rinsing objects, which device comprises a holder for supporting an object to be cleaned, the holder having at least two passages to the object when the object is situated in said holder in operation, at least two reservoirs for holding rinsing liquid, a first reservoir communicating with a first passage and a second reservoir communicating with a second passage, at least the first reservoir having a variable volume, wherein at least one of said first and second reservoirs is a vessel with rinsing liquid and the holder is provided with a piston which is movable in the vessel.

2. A device as claimed in claim 1, wherein the first reservoir is an elastic bellows and the second reservoir-is formed by the vessel.

3. A device as claimed in claim 2, wherein the piston is supported by a spring.

4. A device as claimed in claim 2, wherein the holder has two passages at opposite sides of the object and an opening for receiving the object, which opening is situated between the two passages.

5. A device as claimed in claim 4, which further comprises a valve system with at least one filter for retaining contaminants from the rinsing liquid.

6. A device as claimed in claim 5, wherein one reservoir is situated above the other reservoir, the lower reservoir being provided with a bell-shaped portion forming an air space.

7. A device for rinsing objects, which device comprises a holder for supporting an object to be cleaned, the holder having at least two passages to the object when the object is situated in said holder in operation, at least two reservoirs for holding rinsing liquid, a first reservoir communicating with a first passage and a second reservoir communicating with a second passage, at least the first reservoir having a variable volume, and a filter for retaining contaminants from the rinsing liquid, said rinsing being obtained by pumping the liquid from the first reservoir to the second reservoir and/or from the second reservoir to the first reservoir.

8. A device as claimed in claim 7, wherein the filter is situated in one of the passages to the reservoirs.

9. A device as claimed in claim 7, wherein the device comprises a valve means effective to control the direction of passage of the liquid through the filter during rinsing.

10. A device as claimed in claim 9, wherein the filter is arranged in the first passage of the first reservoir.

11. A device for rinsing objects, which device comprises a holder for supporting an object to be cleaned, the holder having at least two passages to the object when the object is situated in said holder in operation, at least two reservoirs for holding rinsing liquid, a first elastically depressible housing section forming a first reservoir which communicates with a first passage, a flexible diaphragm adjacent the first reservoir, a space adjacent the flexible diaphragm forming a second reservoir which communicates with a second passage.

12. A device as claimed in claim 11, wherein the device also comprises at least one filter for retaining contaminants from the rinsing liquid.

13. A device as claimed in claim 12, wherein the filter is situated in one of the passages to the reservoirs.

14. A device as claimed in claim 12, wherein the device comprises valve means effective to control the direction of passage of the liquid through the filter during rinsing.

15. A device as claimed in claim 12, wherein said elastically depressible housing section has an upper housing section mounted thereon, said flexible diaphragm being arranged in the upper housing section, a space beneath the flexible diaphragm forming the second reservoir.

16. A device as claimed in claim 15, wherein the filter is contained in a walled box with multiple openings, a first opening being provided with a first valve and a second opening being provided with a second valve which is closed when the first valve is open and open when the first valve is closed, the first valve being open when the upper housing section is pressed down.

17. A device as claimed in claim 15, wherein the filter is ring-shaped and contained in a walled box with multiple openings, a wall portion having a first opening being provided with a first valve which can be opened or closed and a second wall portion having a second opening being provided with a second valve which can be opened or closed, the first valve being open and the second valve being closed when the upper housing section is pressed down, the second valve being open and the first valve being closed when the upper housing section is released thereby forcing the rinsing liquid with contaminants through the filter.

18. A device as claimed in claim 15, wherein the elastically depressible reservoir is situated above the second reservoir, the second reservoir being provided with a bell shaped wall portion which forms an air space.

19. A device as claimed in claim 18, wherein the filter is situated in the air space of the bell-shaped wall portion.

20. A device as claimed in claim 11, wherein a plate having multiple apertures is disposed in the passage to the second reservoir.

* * * * *